US010830494B2

(12) United States Patent
Goodjohn

(10) Patent No.: US 10,830,494 B2
(45) Date of Patent: Nov. 10, 2020

(54) WATER HEATER APPLIANCE AND METHODS OF OPERATION

(71) Applicant: Haier US Appliance Solutions, Inc., Wilmington, DE (US)

(72) Inventor: Paul Goodjohn, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 206 days.

(21) Appl. No.: 15/919,270

(22) Filed: Mar. 13, 2018

(65) Prior Publication Data

US 2019/0285312 A1 Sep. 19, 2019

(51) Int. Cl.

| | |
|---|---|
| ***H05B 1/02*** | (2006.01) |
| ***F24H 9/20*** | (2006.01) |
| *F24H 1/20* | (2006.01) |

(52) U.S. Cl.

CPC ..... *F24H 9/2021* (2013.01); *F24H 1/201* (2013.01); *F24H 2250/02* (2013.01); *F24H 2250/08* (2013.01); *F24H 2250/12* (2013.01)

(58) Field of Classification Search

CPC .... F24H 9/2021; F24H 1/201; F24H 2250/08; F24H 2250/12; F24K 2250/03; H05B 1/02; H05B 3/0052; H05B 1/0244

USPC ..... 219/492, 494, 497, 501, 476, 479; 392/341, 345, 441, 449, 464, 500

See application file for complete search history.

(56) References Cited

U.S. PATENT DOCUMENTS

| | | | | |
|---|---|---|---|---|
| 4,731,547 | A * | 3/1988 | Alenduff | H02J 3/48 290/2 |
| 9,097,435 | B2 * | 8/2015 | Lichtenberger | F24H 1/202 |
| 2007/0130092 | A1 * | 6/2007 | Lee, Jr. | G01R 21/1338 705/412 |
| 2012/0060829 | A1 * | 3/2012 | DuPlessis | F24D 11/003 126/609 |
| 2012/0078433 | A1 | 3/2012 | Honma et al. | |
| 2018/0073770 | A1 * | 3/2018 | Bourke | F24H 9/2021 |
| 2019/0171276 | A1 * | 6/2019 | Lin | G06F 1/3287 |

FOREIGN PATENT DOCUMENTS

CN 103162420 A 6/2013

* cited by examiner

*Primary Examiner* — Mark H Paschall
(74) *Attorney, Agent, or Firm* — Dority & Manning, P.A.

(57) ABSTRACT

A water heater appliance, including methods of operation, is provided herein. The water heater appliance may include a casing, a tank, an inlet conduit, an electric heating system, and a controller coupled to an auxiliary power generator. The tank may be disposed within the casing and define an inlet and an outlet. The inlet conduit may be mounted to the tank at the inlet of the tank. The controller may be operably coupled to the electric heating system and configured to initiate a heating cycle. The heating cycle may include identifying a daily peak auxiliary power period, determining a contemporary voltage reading at the water heater appliance, predicting an occurrence of the daily peak auxiliary power period from the auxiliary power generator, and heating water within the water heater at the predicted occurrence of the daily peak auxiliary power period.

8 Claims, 3 Drawing Sheets

WATER HEATER APPLIANCE AND METHODS OF OPERATION

FIELD OF THE INVENTION

The present subject matter relates generally to water heater appliances, and more particularly to water heater appliances having an adjustable or variable heating schedule.

BACKGROUND OF THE INVENTION

Water heater storage tanks are used for storing and supplying hot water to residential and commercial properties. A typical residential water heater holds about fifty gallons of water inside a steel reservoir tank. A thermostat is used to control the temperature of the water inside the tank. Many water heaters permit a consumer to set the thermostat to a specific temperature, for example, between 90 and 150 degrees Fahrenheit (F). In order to prevent scalding and to save energy, consumers may set the thermostat to heat the reservoir water to a temperature in a range between 120 degrees F. and 140 degrees F.

A water heater typically delivers hot water according to the thermostat temperature setting. As a consumer draws water from the water heater, the water temperature in the water heater usually drops due to cooler supply water displacing the heated water in the storage tank. As the thermostat senses that the temperature of the water inside the tank drops below thermostat's set point, power is sent to the electric resistance heating element (or a burner in a gas water heater). The electric elements then draw energy to heat the water inside the tank to a preset temperature level.

Water heating may constitute a significant portion (e.g., 10-15%) of household energy usage. In some locations of the United States and globally, the cost for electrical energy to heat water can depend upon the time of day, day of the week and season of the year. In areas of the United States where energy is at a premium, utility companies often divide their time of use rates into off-peak and on-peak energy demand periods with a significant rate difference between the periods. Household energy demands typically correspond to on-peak energy periods where the cost to produce the energy may be at a maximum for the utility company and the cost to use the energy may be at a maximum for the customer. Various conventional energy saving techniques have been utilized in an attempt to minimize the cost of energy to both the utility company and the consumer.

For example, some households have incorporated solar energy panels to generate electricity from sunlight and reduce the amount of energy required from the utility company. However, such systems often produce electricity at off-peak energy times, or without regard to energy prices, minimizing their potential cost-savings impact. In some instances, the energy generated at the solar energy panels will be in excess of what the household needs, forcing a user to shed excess energy to the municipal power grid. If the utility will not purchase excess power, a household may be forced to essentially give the energy to the utility for free.

Accordingly, a need exists for providing a water heater appliance and method of operation that allows for storage during low demand energy production times. In addition, it would be advantageous to have a water heater appliance and method of operation that reduces energy use during on-peak demand time periods.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a water heater appliance is provided. The water heater appliance may include a casing, a tank, an inlet conduit, an electric heating system, and a controller. The tank may be disposed within the casing and define an inlet and an outlet. The inlet conduit may be mounted to the tank at the inlet of the tank. The electric heating system may be in thermal communication with the tank to heat water within the tank. The controller may be operably coupled to the electric heating system and configured to initiate a heating cycle. The heating cycle may include identifying a daily peak auxiliary power period based on a plurality of previous voltage readings at the water heater appliance, determining a contemporary voltage reading at the water heater appliance, predicting an occurrence of the daily peak auxiliary power period from an auxiliary power generator based on the determined contemporary voltage reading, and heating water within the water heater at the predicted occurrence of the daily peak auxiliary power period.

In another exemplary aspect of the present disclosure, a method of operating a water heater appliance is provided. The method may include identifying a daily peak auxiliary power period based on a plurality of previous voltage readings at the water heater appliance. The method may also include determining a contemporary voltage reading at the water heater appliance. The method may further include predicting an occurrence of the daily peak auxiliary power period from an auxiliary power generator based on the determined contemporary voltage reading. The method may still further include heating water within the water heater at the predicted occurrence of the daily peak auxiliary power period.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
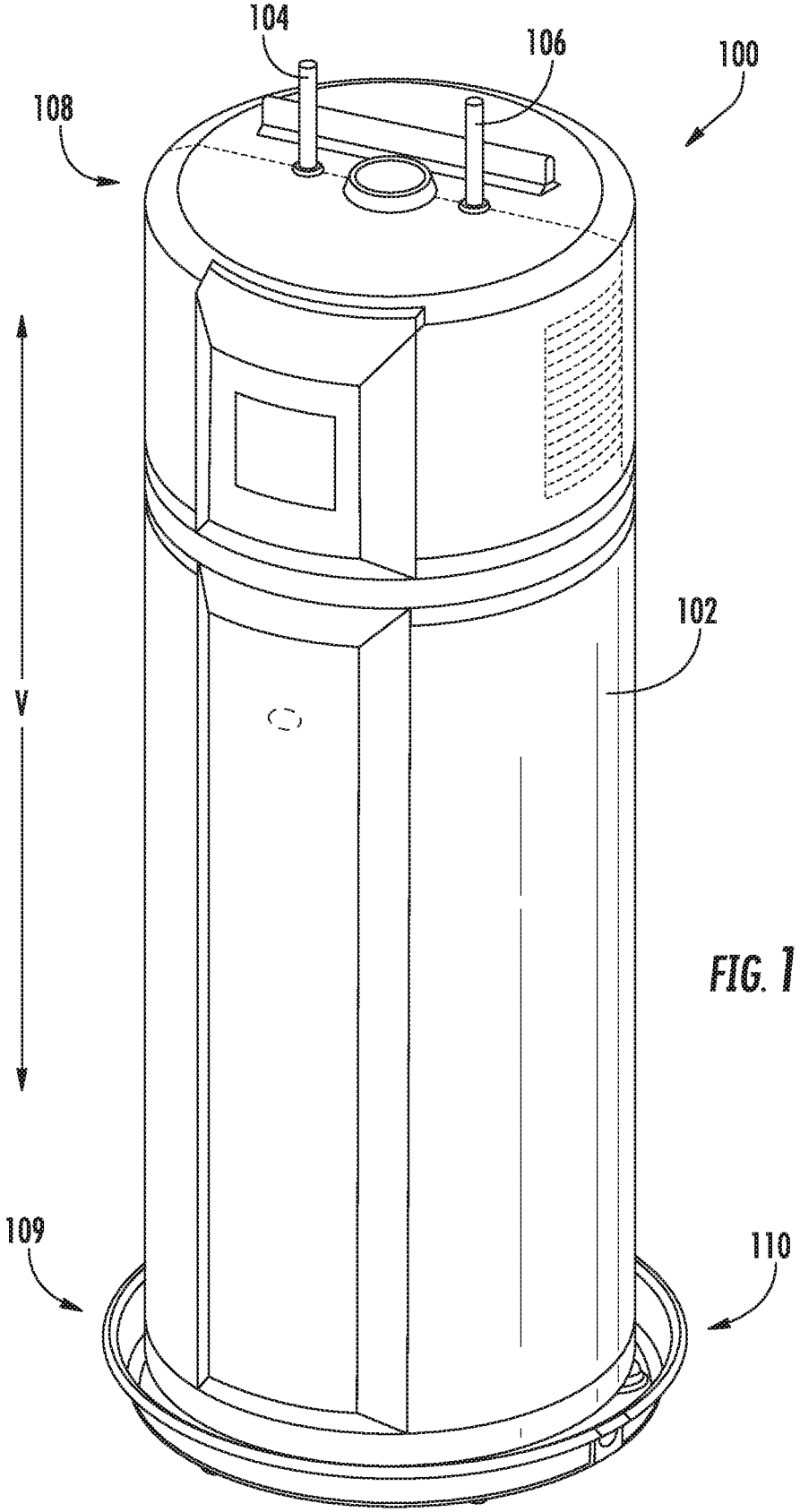
FIG. 1 provides a perspective view of a water heater appliance according to an exemplary embodiment of the present disclosure.

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
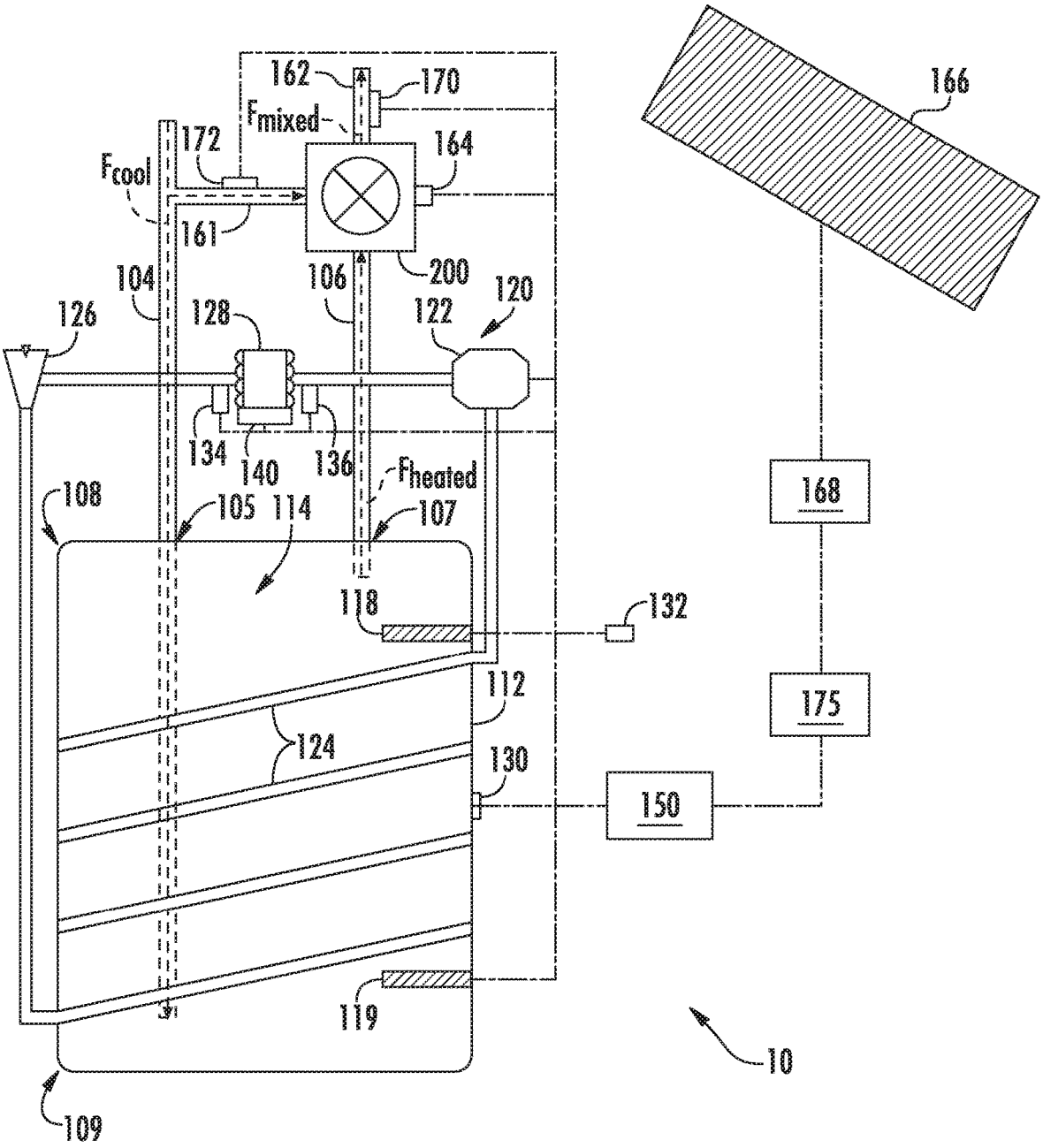
FIG. 2 provides a schematic view of certain components of the exemplary water heater appliance of FIG. 1.

FIG. 1 provides a perspective view of a water heater appliance 100 according to an exemplary embodiment of the present disclosure. FIG. 2 provides a schematic view of certain components of water heater appliance 100 within a heating assembly 10. As may be seen in FIGS. 1 and 2, water heater appliance 100 includes a casing 102 and a tank 112 mounted within casing 102. Tank 112 defines an interior volume 114 for heating water therein.

Water heater appliance 100 also includes an inlet conduit 104 and an outlet conduit 106 that are both in fluid communication with tank 112 within casing 102. As an example, cold water from a water source (e.g., a municipal water supply or a well) enters water heater appliance 100 through inlet conduit 104. From inlet conduit 104, such cold water enters interior volume 114 of tank 112, wherein the water is heated to generate heated water. Such heated water exits water heater appliance 100 at outlet conduit 106 and, for example, is supplied to a bath, shower, sink, or any other suitable feature.

As may be seen in FIG. 1, water heater appliance 100 extends between a top portion 108 and a bottom portion 109 along a vertical direction V. Thus, water heater appliance 100 is generally vertically oriented. Water heater appliance 100 can be leveled (e.g., such that casing 102 is plumb in the vertical direction V) in order to facilitate proper operation of water heater appliance 100.

In some embodiments, a drain pan 110 is positioned at bottom portion 109 of water heater appliance 100 such that water heater appliance 100 sits on drain pan 110. Drain pan 110 sits beneath water heater appliance 100 along the vertical direction V (e.g., to collect water that leaks from water heater appliance 100 or water that condenses on an evaporator 128 of water heater appliance 100). It should be understood that water heater appliance 100 is provided by way of example only and that the present disclosure may be used with any suitable water heater appliance.

Turning now to FIG. 2, exemplary embodiments of water heater appliance 100 include an electric heating system, such as one or more of an upper heating element 118, a lower heating element 119, or a sealed system 120 in thermal communication with the tank 112. During operation of water heater appliance 100, one or all of upper heating element 118, lower heating element 119, or sealed system 120 may thus be selectively activated to heat water within interior volume 114 of tank 112.

As shown, the exemplary embodiments of FIG. 2 include upper heating element 118, lower heating element 119, or sealed system 120. Thus, the exemplary water heater appliance 100 is commonly referred to as a "heat pump water heater appliance." Upper and lower heating elements 118 and 119 can be any suitable heating elements. For example, upper heating element 118 or lower heating element 119 may be an electric resistance element, a microwave element, an induction element, or any other suitable heating element (including combinations thereof). Lower heating element 119 may also be a gas burner. Moreover, it is understood that illustrated heat pump water heater appliance embodiments is merely a non-limiting example, and other water heater appliance configurations may be provided within the scope of the present disclosure (e.g., embodiments including more heating elements, fewer heating elements, or no sealed system).

Sealed system 120 includes a compressor 122, a condenser 124, a throttling device 126, and an evaporator 128. Condenser 124 is thermally coupled or assembled in a heat exchange relationship with tank 112 in order to heat water within interior volume 114 of tank 112 during operation of sealed system 120. In particular, condenser 124 may be a conduit coiled around and mounted to tank 112. During operation of sealed system 120, refrigerant exits evaporator 128 as a fluid in the form of a superheated vapor or high quality vapor mixture. Upon exiting evaporator 128, the refrigerant enters compressor 122 wherein the pressure and temperature of the refrigerant are increased such that the refrigerant becomes a superheated vapor. The superheated vapor from compressor 122 enters condenser 124 wherein it transfers energy to the water within tank 112 and condenses into a saturated liquid or high quality liquid vapor mixture. This high quality/saturated liquid vapor mixture exits condenser 124 and travels through throttling device 126, which is configured for regulating a flow rate of refrigerant therethrough. Upon exiting throttling device 126, the pressure and temperature of the refrigerant drop at which time the refrigerant enters evaporator 128 and the cycle repeats itself. In certain exemplary embodiments, throttling device 126 may be an electronic expansion valve (EEV).

A fan or air handler 140 may assist with heat transfer between air about water heater appliance 100 (e.g., within casing 102) and refrigerant within evaporator 128. Air handler 140 may be positioned within casing 102 on or adjacent evaporator 128. Thus, when activated, air handler 140 may direct a flow of air towards or across evaporator 128, and the flow of air from air handler 140 may assist with heating refrigerant within evaporator 128. It is understood that air handler 140 may be any suitable type of air handler, such as an axial or centrifugal fan.

In certain embodiments, water heater appliance 100 includes a tank temperature sensor 130. Generally, tank temperature sensor 130 is configured for measuring a temperature of water within interior volume 114 of tank 112. Tank temperature sensor 130 can be positioned at any suitable location within or on water heater appliance 100. For example, tank temperature sensor 130 may be positioned within interior volume 114 of tank 112 or may be mounted to tank 112 outside of interior volume 114 of tank 112. When mounted to tank 112 outside of interior volume 114 of tank 112, tank temperature sensor 130 can be configured for indirectly measuring the temperature of water within interior volume 114 of tank 112. For example, tank temperature sensor 130 can measure the temperature of tank 112 and correlate the temperature of tank 112 to the temperature of water within interior volume 114 of tank 112. Tank temperature sensor 130 may also be positioned at or adjacent top portion 108 of water heater appliance 100 (e.g., at or adjacent an inlet of outlet conduit 106).

Tank temperature sensor 130 can be any suitable temperature sensor. For example, tank temperature sensor 130 may be a thermocouple or a thermistor. As may be seen in FIG. 2, in certain exemplary embodiments, tank temperature sensor 130 is the only temperature sensor positioned at or on tank 112 that is configured for measuring the temperature of water within interior volume 114 of tank 112. In alternative exemplary embodiments, however, additional temperature sensors are positioned at or on tank 112 to assist tank temperature sensor 130 with measuring the temperature of water within interior volume 114 of tank 112 (e.g., at other locations within interior volume 114 of tank 112).

In optional embodiments, water heater appliance 100 includes an ambient temperature sensor 132, an evaporator inlet temperature sensor 134, and an evaporator outlet temperature sensor 136. Ambient temperature sensor 132 is configured for measuring a temperature of air about water heater appliance 100. Ambient temperature sensor 132 can be positioned at any suitable location within or on water heater appliance 100. For example, ambient temperature sensor 132 may be mounted to casing 102 (e.g., at or adjacent top portion 108 of water heater appliance 100). Ambient temperature sensor 132 can be any suitable temperature sensor. For example, ambient temperature sensor 132 may be a thermocouple or a thermistor.

Evaporator inlet temperature sensor 134 is configured for measuring a temperature of refrigerant at or adjacent inlet of evaporator 128. Thus, evaporator inlet temperature sensor 134 may be positioned at or adjacent inlet of evaporator 128, as shown in FIG. 2. For example, evaporator inlet temperature sensor 134 may be mounted to tubing that directs refrigerant into evaporator 128 (e.g., at or adjacent inlet of evaporator 128). When mounted to tubing, evaporator inlet temperature sensor 134 can be configured for indirectly measuring the temperature of refrigerant at inlet of evaporator 128. For example, evaporator inlet temperature sensor 134 can measure the temperature of the tubing and correlate the temperature of the tubing to the temperature of refrigerant at inlet of evaporator 128. Evaporator inlet temperature sensor 134 can be any suitable temperature sensor. For example, evaporator inlet temperature sensor 134 may be a thermocouple or a thermistor.

Evaporator outlet temperature sensor 136 is configured for measuring a temperature of refrigerant at or adjacent outlet of evaporator 128. Thus, evaporator outlet temperature sensor 136 may be positioned at or adjacent outlet of evaporator 128, as shown in FIG. 2. For example, evaporator outlet temperature sensor 136 may be mounted to tubing that directs refrigerant out of evaporator 128 (e.g., at or adjacent outlet of evaporator 128). When mounted to tubing, evaporator outlet temperature sensor 136 can be configured for indirectly measuring the temperature of refrigerant at outlet of evaporator 128. For example, evaporator outlet temperature sensor 136 can measure the temperature of the tubing and correlate the temperature of the tubing to the temperature of refrigerant at outlet of evaporator 128. Evaporator outlet temperature sensor 136 can be any suitable temperature sensor. For example, evaporator outlet temperature sensor 136 may be a thermocouple or a thermistor.

Water heater appliance 100 further includes a controller 150 that is configured for regulating operation of water heater appliance 100. In certain embodiments, controller 150 is in operative communication (e.g., direct electrical communication, indirect electrical communication, wireless communication, etc.) with one or more of upper heating element 118, lower heating element 119, compressor 122, tank temperature sensor 130, ambient temperature sensor 132, evaporator inlet temperature sensor 134, evaporator outlet temperature sensor 136, or air handler 140. When installed, controller 150 may further be in operative communication with a power source, such as a residential power grid through, for example, an electrical service panel 175 (e.g., circuit breaker panel). Thus, controller 150 may selectively activate and direct power to upper heating element 118, lower heating element, or compressor 122 in order to heat water within interior volume 114 of tank 112 (e.g., in response to signals from tank temperature sensor 130, ambient temperature sensor 132, evaporator inlet temperature sensor 134, or evaporator outlet temperature sensor 136). Moreover, controller 150 may initiate one or more heating cycles or methods (e.g., method 300—FIG. 3) to control operations of water heater appliance 100.

In some embodiments, controller 150 includes memory (e.g., non-transitive memory) and one or more processing devices (e.g., microprocessors, CPUs or the like), such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 150 may generally operate upper heating element 118, lower heating element 119, or compressor 122 in order to heat water within interior volume 114 of tank 112 (e.g., as part of a heating cycle). As an example, in certain modes of operation, a user may select or establish a set temperature, $t_s$, for water within interior volume 114 of tank 112. Additionally or alternatively, the set temperature $t_s$ for water within interior volume 114 of tank 112 may be a default value. Based upon the set temperature $t_s$ for water within interior volume 114 of tank 112, controller 150 may selectively activate upper heating element 118, lower heating element 119, or compressor 122. For instance, a temperature range (e.g., a range between about fifteen degrees Fahrenheit and about twenty five degrees Fahrenheit) may be provided for the set temperature $t_s$. In other words, a range may be provided that includes a set temperature minimum $t_{smin}$ and a set temperature maximum $t_{smin}$ that is below and above, respectively, the set temperature $t_s$. If the water within interior volume 114 of tank 112 falls below the set temperature minimum $t_{smin}$, upper heating element 118, lower heating element 119, or compressor 122 may be activated to heat the water. If the water within interior volume 114 of tank 112 rises above the set temperature maximum $t_{smax}$, upper heating element 118, lower heating element 119, or compressor 122 may be deactivated to stop heating the water.

The set temperature $t_s$ for water within interior volume 114 of tank 112 may be any suitable temperature. For example, the set temperature $t_s$ for water within interior volume 114 of tank 112 may be a value between about one hundred degrees Fahrenheit and about one hundred-eighty degrees Fahrenheit. As used herein with regards to temperature approximations, the term "about" means within ten degrees of the stated temperature.

As may be seen in FIG. 2, in some embodiments, water heater appliance 100 includes a mixing valve 200 and a mixed water outlet conduit 162. Generally, mixing valve 200 is in fluid communication with inlet conduit 104 via a bypass conduit 161, outlet conduit 106, and mixed water outlet conduit 162. In some such embodiments, mixing valve 200 is configured for selectively directing water from inlet conduit 104 and outlet conduit 106 into mixed water outlet conduit 162 in order to regulate a temperature of water within mixed water outlet conduit 162. Optionally, mixing valve 200 may be positioned or disposed within casing 102 of water heater appliance 100 (e.g., such that mixing valve 200 is integrated within water heater appliance 100).

In exemplary embodiments, mixing valve 200 can selectively adjust between a first position and a second position. In the first position, mixing valve 200 can permit a first flow rate of relatively cool water from inlet conduit 104 (shown schematically with arrow labeled $F_{cool}$ in FIG. 2) into mixed water outlet conduit 162 and mixing valve 200 can also permit a first flow rate of relatively hot water from outlet conduit 106 (shown schematically with arrow labeled $F_{heated}$ in FIG. 2) into mixed water outlet conduit 162. In such a manner, water within mixed water outlet conduit 162 (shown schematically with arrow labeled $F_{mixed}$ in FIG. 2) can have a first particular temperature when mixing valve 200 is in the first position. Similarly, mixing valve 200 can permit a second flow rate of relatively cool water from inlet conduit 104 into mixed water outlet conduit 162 and mixing valve 200 can also permit a second flow rate of relatively hot water from outlet conduit 106 into mixed water outlet conduit 162 in the second position. The first and second flow rates of the relatively cool water and relatively hot water are different such that water within mixed water outlet conduit 162 can have a second particular temperature when mixing valve 200 is in the second position. In such a manner, mixing valve 200 can regulate the temperature of water within mixed water outlet conduit 162 and adjust the temperature of water within mixed water outlet conduit 162 between the first and second particular temperatures.

It should be understood that, in additional or alternative exemplary embodiments, mixing valve 200 is adjustable between more positions than the first and second positions. In particular, mixing valve 200 may be adjustable between any suitable number of positions in alternative exemplary embodiments. For example, mixing valve 200 may be infinitely adjustable in order to permit fine-tuning of the temperature of water within mixed water outlet conduit 162.

As shown, water heater appliance 100 may also include a position sensor 164. Position sensor 164 is configured for determining a position of mixing valve 200. Position sensor 164 can monitor the position of mixing valve 200 in order to assist with regulating the temperature of water within mixed water outlet conduit 162. For example, position sensor 164 can determine when mixing valve 200 is in the first position or the second position in order to ensure that mixing valve 200 is properly or suitably positioned depending upon the temperature of water within mixed water outlet conduit 162 desired or selected. Thus, position sensor 164 can provide feedback regarding the status or position of mixing valve 200.

Position sensor 164 may be any suitable type of sensor. For example, position sensor 164 may be a physical sensor, such as an optical sensor, Hall-effect sensor, etc. In alternative exemplary embodiments, water heater appliance 100 need not include position sensor 164, and controller 150 may determine or measure a motor position of mixing valve 200 based on a previously commanded position of mixing valve 200. Thus, controller 150 may determine that the current position of mixing valve 200 corresponds to a latest position that controller 150 commanded for mixing valve 200 in a previous iteration.

In certain embodiments, water heater appliance 100 also includes a mixed water conduit temperature sensor or first temperature sensor 170 and an inlet conduit temperature sensor or second temperature sensor 172. First temperature sensor 170 may be positioned on or proximate to mixed water outlet conduit 162 and is configured for measuring a temperature of water within mixed water outlet conduit 162. As shown, first temperature sensor 170 may also be positioned downstream of mixing valve 200. Second temperature sensor 172 is positioned on or proximate to inlet conduit 104 or bypass conduit 161 and is configured for measuring a temperature of water within inlet conduit 104 or bypass conduit 161. Second temperature sensor 172 may be positioned upstream of mixing valve 200. In certain exemplary embodiments, first temperature sensor 170 or second temperature sensor 172 may be positioned proximate or adjacent to mixing valve 200. First and second temperature sensors 170, 172 may be any suitable type of temperature sensors, such as a thermistor or thermocouple.

In some embodiments, controller 150 can also operate mixing valve 200 to regulate the temperature of water within mixed water outlet conduit 162. For instance, controller 150 can adjust the position of mixing valve 200 in order to regulate the temperature of water within mixed water outlet conduit 162. As an example, a user can select or establish a set-point temperature of mixing valve 200, or the set-point temperature of mixing valve 200 may be a default value. Based upon the set-point temperature of mixing valve 200, controller 150 can adjust the position of mixing valve 200 in order to set or adjust a ratio of relatively cool water flowing into mixed water outlet conduit 162 from inlet conduit 104 and relatively hot water flowing into mixed water outlet conduit 162 from outlet conduit 106. In such a manner, controller 150 can regulate the temperature of water within mixed water outlet conduit 162.

The set-point temperature of mixing valve 200 can be any suitable temperature. For example, the set-point temperature of mixing valve 200 may be a value between about one hundred degrees Fahrenheit and about one hundred and twenty degrees Fahrenheit. In particular, the set-point temperature of mixing valve 200 may be selected such that the set-point temperature of mixing valve 200 is less than the set-point temperature for water within interior volume 114 of tank 112. In such a manner, mixing valve 200 can utilize water from inlet conduit 104 and outlet conduit 106 to regulate the temperature of water within mixed water outlet conduit 162.

Remaining at FIG. 2, a domestic or residential auxiliary power generator 166 is provided in operative communication with water heater appliance 100. For instance, auxiliary power generator 166 may be connected to electrical service panel 175 as part of the heating assembly 10. In some such embodiments, one or more treatment elements, such as a power inverter 168, may be provided between (e.g., in electrical communication between) auxiliary power generator 166 and electrical service panel 175 to treat an electrical current from auxiliary power generator 166. As would be understood, inverter 168 may convert or transform a direct electrical current generated at auxiliary power generator 166 into an alternating electrical current that may be used within a residence or returned to a municipal power grid (e.g., as allocated by electrical service panel 175).

Generally, auxiliary power generator 166 may be provided with assembly 10 as any suitable device or assembly for generating electrical power independent from the municipal power grid. As an example, auxiliary power generator 166 may include a solar electricity generator, such as a solar panel or array (e.g., photovoltaic panels) for generating an electrical current from absorbed solar energy. In some such embodiments, the solar electricity generator is mounted on or beside the building or house in which the water heater appliance 100 is mounted. As another example, auxiliary power generator 166 may include an alternative generator or turbine for generating an electrical current from rotation of one or more corresponding turbines (e.g., as motivated by air or water movement therethrough). In some such embodiments, the alternative generator is mounted on or beside the building or house in which the water heater appliance 100 is mounted.

In some embodiments, controller 150 is configured to monitor and receive voltage readings during certain operations or modes of operation for water heater appliance 100. In particular, controller 150 may receive line voltage readings from a corresponding current between controller 150 and electrical service panel 175. The readings may include an absolute voltage value and voltage and current phase information for the corresponding current. Utilizing such voltage readings, controller 150 may detect power generation at auxiliary power generator 166. For instance, power generation at auxiliary power generator 166 may cause an increase in the line voltage value between controller 150 and electrical service panel 175 (e.g., in comparison to a state of no power generation at auxiliary power generator 166). The voltage and current phase (i.e., V/C phase) from power generation at auxiliary power generator 166 may also be distinct from the V/C phase from, for instance, the municipal power grid. Such line voltage values and V/C phases may be detected and measured as readings at controller 150. Optionally, the time (e.g., time of day) at which the voltage readings are provided may further be recorded. Additionally or alternatively, sensors may be provided (not pictured) within the assembly 10 to examine the voltage presented to water heater appliance 100, as well as the phase, variation, or distortion of the corresponding waveform for the voltage/current. Such information may be transmitted to controller 150 as one or more sensor signal.

Figure 3:
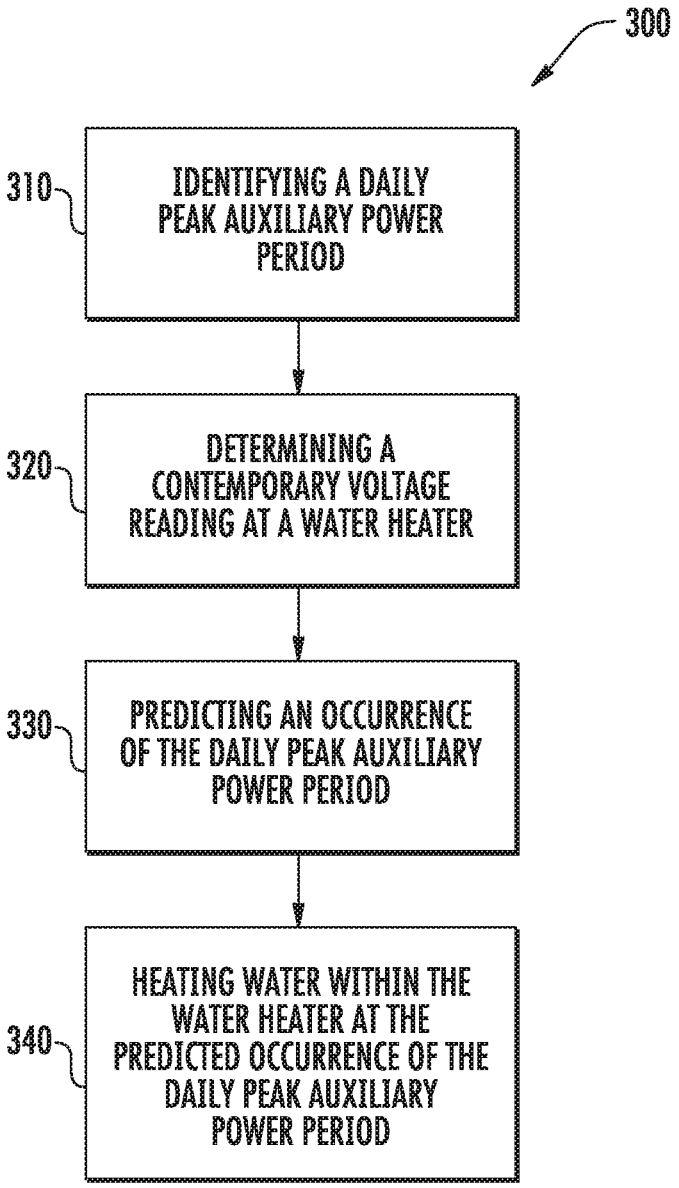
FIG. 3 provides a flow chart illustrating a method of operating a water heater appliance according to exemplary embodiments of the present disclosure.

Turning now to FIG. 3, a flow diagram is provided of a method 300 according to an exemplary embodiment of the present disclosure. Generally, the method 300 provides for controlling and operating a water heater appliance 100 (FIG. 2) (e.g., according to a heating cycle). In particular, method 300 may provide for directing operations at one or more of upper heating element 118, lower heating element 119, compressor 122, or mixing valve 200 (FIG. 2). The method 300 may be performed, for instance, by the controller 150. As described above, the controller 150 may be in operative communication with upper heating element 118, lower heating element 119, compressor 122, mixing valve 200, or auxiliary power generator 166. Controller 150 may send signals to and receive signals from one or more of upper heating element 118, lower heating element 119, compressor 122, mixing valve 200, or auxiliary power generator 166. Controller 150 may further be in communication with other suitable components of the appliance to facilitate operation of the water heater appliance 100 generally.

Referring to FIG. 3, at 310, the method 300 includes identifying a daily peak auxiliary power period. The daily peak auxiliary power period is generally understood to be a continuous period or subset of time (e.g., in seconds, minutes, or hours) in a day during which auxiliary power (e.g., power generated at the auxiliary power generator) is expected to be greatest, or otherwise above a typical value. As an example, the daily peak auxiliary power period may be a continuous and uninterrupted period of time between one hour and three hours during a single day (i.e., twenty four hour period).

In some embodiments, the daily peak auxiliary power period is preprogrammed and stored as data within controller. Identification at 310 may thus include reading the stored data relating to the daily peak auxiliary power period. In additional or alternative embodiments, the identification at 310 is based on a plurality of previous voltage readings at the water heater appliance. For instance, as described above, the controller of the water heater appliance may determine voltage readings when a voltage increase occurs during power generation at the auxiliary power generator. Such readings may be received and recorded over time (e.g., at predetermined times of day or at a predetermined rate). The readings may be collected over the course of multiple discrete days. In turn, a collection of previous voltage readings may be collected (e.g., organized as a table, graph, chart, etc.) for multiple discrete days. Advantageously, the daily peak auxiliary power may account for the exact location and environment in which the water heater appliance and auxiliary power generator or installed.

In certain embodiments, at 310, one or more daily patterns may be determined from the collected previous voltage readings. In particular, a daily extrema voltage pattern may be identified. In some such embodiments, the controller may determine a discrete voltage extreme (e.g., maximum absolute voltage value) for multiple discrete days within the plurality of previous voltage readings. In other words, each day of the multiple discrete days may have a determined voltage extreme. Moreover, the controller may determine whether to attribute such voltage extrema to the auxiliary power generator. In other words, the controller may determine if a particular voltage extreme was caused by power generation at the auxiliary power generator. In such embodiments, attribution is made based on the V/C phase. For instance, the controller may determine whether the voltage extreme has a V/C phase that corresponds to the auxiliary power generator or, alternatively, the power grid.

After multiple voltage extrema have been determined, a corresponding pattern may be developed. The pattern may account for when a typical (e.g., mean or median) voltage extreme occurs, as well as the voltage values or rates of change before and after the voltage extreme occurs. Using, for instance, the voltage values before and after the voltage extreme, the controller may identify a daily extrema voltage pattern for the rise and fall of voltage readings from the auxiliary power. In particular, a peak initiation point and a peak end point may be identified. The peak initiation point and peak end point may each be provided as a separate voltage value or rate of change. Moreover, one or both of the peak initiation point and peak end point may be determined based on the sequence of occurrences (e.g., temporal relationship to a corresponding voltage extreme) within a corresponding day or time period.

In embodiments wherein the auxiliary power generator includes a solar electricity generator, the voltage extrema pattern may follow a pattern of available solar energy at the exact mounted location of the solar electricity generator. Optionally, a new pattern may be developed at a preset rate, for instance, such that a new pattern is developed after a specified number of days, weeks, or months has expired from the time in which one pattern was developed. It is understood that other methods and examples may include additional or alternative steps for determining a daily peak auxiliary power period (e.g., using pattern recognition for data collected as previous voltage readings).

At 320, the method 300 includes determining a contemporary voltage reading at the water heater. As described above, each voltage reading may include an absolute voltage value and V/C phase (i.e., information or data regarding the V/C phase). In turn, the contemporary voltage reading may include the voltage value and V/C phase at the time the contemporary voltage reading was determined. In some embodiments, 320 includes receiving a line voltage between the electrical service panel and the controller. In additional or alternative embodiments, 320 includes receiving a transmitted sensor signal (e.g., from a mounted voltage sensor in electrical communication with auxiliary power generator).

At 330, the method 300 includes predicting an occurrence of the daily peak auxiliary power period from the auxiliary power generator. Thus, before a daily occurrence of the peak auxiliary period begins, the method 300 may determine that such an occurrence is imminent. In some embodiments, the prediction at 330 is based on the determined contemporary voltage reading at 320. For instance, the voltage reading at 330 may be compared to previous voltage readings. If the contemporary voltage reading is within a predefined range or percentage of, for instance, the peak initiation point, the controller may predict the peak auxiliary power period is likely to occur (e.g., within a set amount of time).

In some embodiments, a pre-peak period is established based on the predicted occurrence of the daily peak auxiliary period. For instance, the pre-peak period may be a set amount of time (e.g., between one hour to five hours) immediately preceding the predicted occurrence of the daily peak auxiliary power period. During the pre-peak period, the water heater appliance may be operated in an energy conservation mode limiting the activation or heat provided by one or more of the upper heating element, the lower heating element, or the compressor. In some such embodiments, the controller may permit a minimum temperature (e.g., a first minimum set temperature $t_{smin}$) to be reached within the interior of the water heater appliance during the pre-peak period. For instance, regardless of the temperature or operations prior to the pre-peak period, the controller may deactivate one or more of the upper heating element, the lower heating element, or the compressor until the minimum temperature is reached. In additional or alternative embodiments, a new minimum temperature (e.g., second minimum set temperature $t_{smin2}$) may be set for the pre-peak period (e.g., for the entire duration of the pre-peak period). The new minimum temperature may be less than the first minimum temperature (e.g., minimum set temperature $t_{smin}$). In turn, the temperature within the interior of the tank may be lower (i.e., colder) during the pre-peak period than at other time periods during the operation of the water heater appliance.

At 340, the method 300 includes heating water within the water heater at the predicted occurrence of the daily peak auxiliary power period. For instance, the controller may activate one or more of the upper heating element, the lower heating element, or the compressor. Optionally, the activation may be initiated or started at the peak initiation point or according to a contemporary measured temperature within the interior of the tank.

During the predicted peak occurrence, the water heater appliance may be operated in a high consumption mode generally increasing the activation or heat provided by one or more of the upper heating element, the lower heating element, or the compressor. In some such embodiments, the controller may permit a maximum temperature (e.g., a first maximum set temperature $t_{smax}$) to be reached within the interior of the water heater appliance during the predicted peak occurrence. For instance, regardless of the temperature or operations prior to predicted peak occurrence (e.g., during the pre-peak period), the controller may activate one or more of the upper heating element, the lower heating element, or the compressor until the maximum temperature is reached. In additional or alternative embodiments, a new maximum temperature (e.g., second maximum set temperature $t_{smax2}$) may be set for the pre-peak period (e.g., for the entire duration of the pre-peak period). The new maximum temperature may be greater than the first maximum temperature (e.g., maximum set temperature $t_{smax}$). In turn, the temperature within the interior of the tank may be higher (i.e., hotter) during the predicted peak occurrence than at other time periods during the operation of the water heater appliance.

Once the predicted peak occurrence expires (e.g., upon a subsequent determination of that the predicted peak occurrence has expired), the water heater appliance may return to the previous heating cycle or mode of operation (e.g., wherein the first maximum set temperature $t_{smax}$ is utilized). For instance, the controller may determine expiration of the predicted peak occurrence based on a new determined contemporary voltage reading. For instance, the new voltage reading may be compared to previous voltage readings. If the new contemporary voltage reading is within a predefined range or percentage of, for instance, the peak end point, the controller may determine the predicted peak occurrence has occurred. Additionally or alternatively, the controller may determine expiration of the predicted peak occurrence based on the passage of a set amount of time following the start of the predicted peak occurrence.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water heater appliance comprising:

a casing;

a tank disposed within the casing, the tank defining an inlet and an outlet;

an inlet conduit mounted to the tank at the inlet of the tank;

an electric heating system in thermal communication with the tank to heat water within the tank;

a controller operably coupled to the electric heating system, and a sensor operably coupled to the controller and an auxiliary power generator, the auxiliary power generator comprising a solar electricity generator, wherein the controller comprises a processor and memory, the controller being configured to initiate a heating cycle, the heating cycle comprising recording, at the memory, a plurality of previous voltage readings from the sensor based on a corresponding current generated the auxiliary power generator at during power generation, identifying a daily peak auxiliary power period based on the plurality of previous voltage readings at the water heater appliance, determining a contemporary voltage reading at the water heater appliance, predicting an occurrence of the daily peak auxiliary power period from the auxiliary power generator based on the determined contemporary voltage reading, and heating water within the water heater at the predicted occurrence of the daily peak auxiliary power period.

2. The water heater appliance of claim 1, wherein the heating cycle further comprises establishing a pre-peak period lasting for a set amount of time immediately preceding the predicted occurrence of the daily peak auxiliary power period.

3. The water heater appliance of claim 2, wherein the heating cycle further comprises permitting a minimum temperature to be reached during the pre-peak period.

4. The water heater appliance of claim 2, wherein the heating cycle further comprises setting a new minimum temperature for the pre-peak period.

5. The water heater appliance of claim 1, wherein the heating cycle further comprises setting a new maximum temperature for the daily peak auxiliary power period.

6. The water heater appliance of claim 1, wherein the plurality of previous voltage readings include voltage readings from multiple discrete days, and wherein identifying a daily peak auxiliary power period comprises identifying a daily extrema voltage pattern of the plurality of previous voltage readings.

7. The water heater appliance of claim 1, wherein the plurality of previous voltage readings each include an absolute voltage value and a current phase.

8. The water heater appliance of claim 7, wherein identifying a daily peak auxiliary power period comprises attributing one or more voltage readings of the plurality of previous voltage readings to the auxiliary power generator based on the voltage and current phase.

* * * * *